US009027501B2

(12) United States Patent
Wood et al.

(10) Patent No.: US 9,027,501 B2
(45) Date of Patent: May 12, 2015

(54) STAND-UP PADDLEBOARD STOOL

(71) Applicant: Beach Craft Products, Inc., La Mesa, CA (US)

(72) Inventors: Bruce G. Wood, La Mesa, CA (US); Jason K. Clark, Corona, CA (US); Gary J. Wood, El Cajon, CA (US)

(73) Assignee: Beach Craft Products, Inc., La Mesa, CA (US)

( * ) Notice: Subject to any disclaimer, the term of this patent is extended or adjusted under 35 U.S.C. 154(b) by 138 days.

(21) Appl. No.: 13/792,553

(22) Filed: Mar. 11, 2013

(65) Prior Publication Data

US 2013/0189885 A1 Jul. 25, 2013

Related U.S. Application Data

(63) Continuation-in-part of application No. 12/928,657, filed on Dec. 16, 2010, now abandoned.

(51) Int. Cl.

| | |
|---|---|
| ***B63B 17/00*** | (2006.01) |
| ***B63B 29/04*** | (2006.01) |
| ***B63B 35/79*** | (2006.01) |
| *B63B 35/71* | (2006.01) |

(52) U.S. Cl.

CPC ..... *B63B 29/04* (2013.01); *B63B 35/79* (2013.01); *B63B 35/71* (2013.01); *B63B 2029/043* (2013.01)

(58) Field of Classification Search

CPC .. B63B 29/04; B63B 2029/043; B63B 29/06; B63B 35/71; B63B 35/79; E05D 11/1007

USPC ..... 108/115, 118, 120; 114/363, 354; 297/29, 118, 130, 195.1, 195.11, 297/195.12, 195.13, 440.24, 451.5, 451.7, 297/451.13, 461; 441/65, 72

See application file for complete search history.

(56) References Cited

U.S. PATENT DOCUMENTS

| | | | | |
|---|---|---|---|---|
| 4,928,620 | A | 5/1990 | Currey | |
| 5,329,871 | A | 7/1994 | Gibbs | |
| 5,901,658 | A | 5/1999 | Kirkland | |
| 6,062,638 | A * | 5/2000 | Ferguson | 297/4 |
| 7,396,083 | B2 * | 7/2008 | Kasner | 297/451.4 |
| 2011/0088610 | A1 | 4/2011 | Wood | |

FOREIGN PATENT DOCUMENTS

| | | | |
|---|---|---|---|
| EP | 124675 | A1 * | 11/1984 |
| EP | 139957 | A2 * | 5/1985 |

* cited by examiner

*Primary Examiner* — S. Joseph Morano
*Assistant Examiner* — Anthony Wiest
(74) *Attorney, Agent, or Firm* — Nydegger & Associates

(57) ABSTRACT

A seat assembly for use on a stand-up paddleboard includes a base member which defines a base axis. A support shaft, with an affixed seat member, is engaged with the base member. In detail, the support shaft defines a shaft axis and is formed with diametrically opposed slots along the length of the support shaft. Protrusions, formed on the base member, are engaged with respective slots on the support shaft to selectively move the support shaft on the base member between a stowed configuration wherein the shaft axis is substantially perpendicular to the base axis, and a sitting configuration wherein the shaft axis is coaxially aligned with the base axis. In operation, a reconfiguration of the seat assembly is accomplished to provide the stand-up paddleboard user with a place to sit during an on-the-water operation of the stand-up paddleboard.

18 Claims, 2 Drawing Sheets

STAND-UP PADDLEBOARD STOOL

This application is a Continuation-in-Part of application Ser. No. 12/928,657, filed Dec. 16, 2010, which is currently pending. The contents of application Ser. No. 12/928,657 are incorporated herein by reference.

FIELD OF THE INVENTION

The present invention pertains generally to auxiliary equipment for recreational watercraft. More particularly, the present invention pertains to a portable seat assembly that can be selectively incorporated into an on-the-water operation of a stand-up paddleboard (SUP). The present invention is particularly, but not exclusively, useful as a seat assembly that can be selectively reconfigured to provide the SUP user with a place to sit during an on-the-water operation of an SUP.

BACKGROUND OF THE INVENTION

It is readily apparent that it can be tiresome for a user (paddler) to remain standing on an SUP for an extended period of time. Although SUPs were originally designed with the intention that the user will remain standing while paddling the SUP, variations from this routine may be desirable for any of several different reasons. Moreover, at times when it is desirable to have the SUP remain substantially stationary (e.g. when fishing), an ability to sit down on something (e.g. a seat assembly), other than the SUP itself, can be quite beneficial.

During an on-the-water operation of a stand-up paddleboard, the use of an on-board seat assembly raises several issues. For one, if the seat assembly is not affixed to the SUP, which is preferable, it needs to be buoyant so it will float for easy retrieval in the event the seat assembly somehow falls overboard. For another, during an on-the-water operation, the seat assembly should be capable of being stowed on the SUP in a compact configuration. The purpose here is to help prevent the seat assembly from interfering with the SUP user while he/she is standing and paddling on the SUP. It then necessarily follows that the seat assembly should be easily reconfigured from its stowed configuration, and into a sitting configuration, to provide a sit down device (i.e. the seat assembly) for use by the SUP user.

In light of the above, it is an object of the present invention to provide a floatable seat assembly that is easily reconfigured, during an on-the-water operation, from a relatively compact, stowed configuration and into a sitting configuration, and vice versa. Another object of the present invention is to provide a seat assembly for a stand-up paddleboard that gives the user the option of sitting or standing during an on-the-water operation of the stand-up paddleboard. Still another object of the present invention is to allow for core and upper body strengthening for the user, as well as cross training for various other paddle sports. Yet another object of the present invention is to provide a seat assembly for use on a stand-up paddleboard that is simple to use, is easy to manufacture and is comparatively cost effective.

SUMMARY OF THE INVENTION

In accordance with the present invention, a seat assembly is provided which gives the user of a stand-up paddleboard (SUP) the option of either standing or sitting during an on-the-water operation of the SUP. Importantly, in its operation, the seat assembly is easily reconfigured between a stowed configuration and a sitting configuration. Also, the seat assembly can be moved around on the SUP for the convenience of the user, and it floats to facilitate an easy retrieval of the seat assembly in the event it falls overboard.

Structurally, the seat assembly of the present invention includes a base member that is formed with a substantially cylindrical shaped receptacle. Further, the receptacle of the base member defines a base axis. Also included in the seat assembly is a hollow cylindrical shaped support shaft that is engaged in combination with the base member. In more detail, the cylindrical shaped support shaft has a first end and a second end, and it defines a shaft axis. The outer surface of the support shaft is formed with diametrically opposed slots which are aligned on the support shaft to extend between its first and second ends. A seat member is affixed to the first end of the support shaft.

A pair of protrusions is mounted on the base member, with the individual protrusions being diametrically opposed to each other relative to the base axis of the base member. Each protrusion on the base member is thus engaged with a respective slot on the support shaft. With the interaction of the protrusions in the slots, the support shaft can be moved on the base member. More specifically, as intended for the present invention, this movement will be between a stowed configuration and a sitting configuration. In the stowed position, the support shaft rests on the base member and the shaft axis is oriented substantially perpendicular to the base axis. On the other hand, in the sitting configuration, the shaft axis is coaxially aligned with the base axis and the second end of the support shaft is inserted into the receptacle to provide stabilization for the seat assembly on the base member.

Additional structural aspects of the seat assembly for the present invention are evidenced by the fact that the support shaft is formed with a buoyancy chamber. As an additional consideration for buoyancy, it is to be appreciated that the base member, the support shaft, and the seat member are all made of a light weight plastic material.

Other features of the present invention include an elongated strap handle that interconnects the seat member with the support shaft. Essentially, the purpose of the strap handle is to facilitate a manipulation of the seat assembly on the SUP. Also, a plurality of pads is attached to the bottom of the base member to stabilize the interaction of the base member with the SUP.

With specific regard to the seat member, it is preferably semi-cylindrical in shape and has a convex outer surface that is opposed to a concave inner surface. The inner surface is affixed to, and is centered on, the first end of the support shaft. Further, the seat member comprises a cushion that is positioned over the convex outer surface of the seat member. Again, with overall buoyancy in mind, the cushion is made of a light weight foam material having a density that is less than the density of water.

Operationally it is envisioned that at the beginning of an on-the-water operation of the seat assembly on an SUP, the seat assembly will be positioned near the bow of the SUP in its stowed configuration, at a stow position. Then, whenever the SUP user wants to sit down on the seat assembly, either to rest or to continue paddling in a sitting position, the user goes through a simple four-step procedure to reconfigure the seat assembly.

As envisioned for the present invention, a reconfiguration of the seat assembly will be accomplished during an on-the-water operation of the SUP. First: the seat assembly is repositioned on the SUP to a location that is selected by the user (most likely this location will be near mid-board and closer to the stern of the SUP). Second: the seat assembly is manipulated into an intermediate configuration wherein the support shaft has been moved to position the protrusions on the base member in the slots of the support shaft at the second end of the support shaft. This distances the seat member from the base member. Note: in this intermediate configuration the shaft axis of the support shaft is still substantially perpendicular to the base axis of the base member. Third: the support shaft is rotated about an axis defined by the protrusions on the base member. This rotation then coaxially aligns the shaft axis of the support shaft with the base axis of the base member. Fourth: the second end of the support shaft is inserted into the receptacle of the base member to establish the sitting configuration for the seat assembly. A return of the seat assembly to its stowed configuration is then accomplished by essentially performing the four-step procedure in reverse order.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
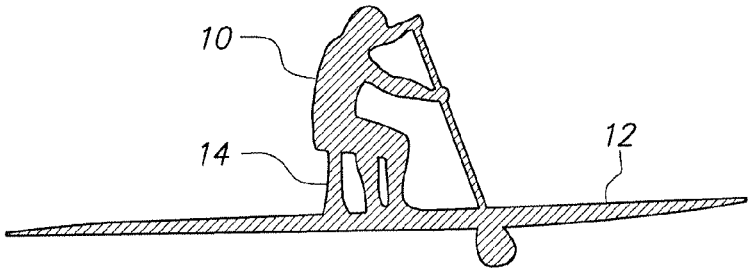
FIG. 1 is a silhouette presentation of a stand-up paddleboard (SUP) user sitting on a seat assembly during an on-the-water operation of the present invention.
Figure 2A:
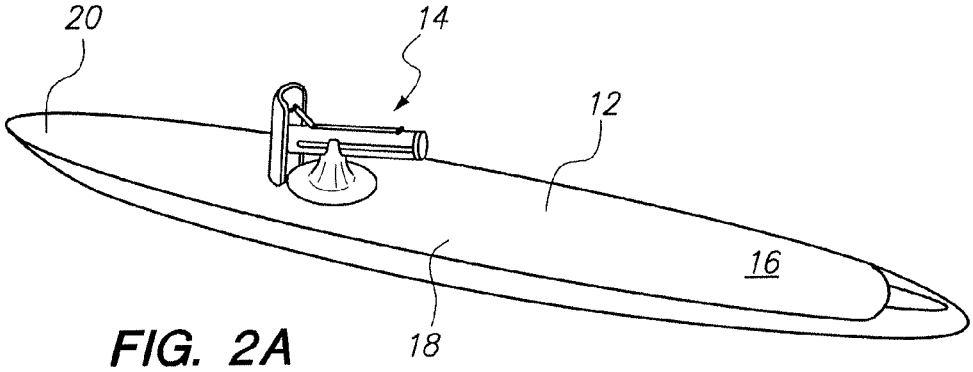
FIG. 2A is a perspective view of an SUP with the seat assembly of the present invention in a stowed configuration, and positioned near the bow of the SUP (stow position)

Referring initially to FIG. 1 a user 10 of a stand-up paddleboard (SUP) 12 is shown paddling the SUP 12 while sitting on a seat assembly 14. As envisioned for the present invention, the seat assembly 14 can be moved around on the upper surface 16 (see FIG. 2A) of the SUP 12, at the convenience of the user 10, during an on-the-water operation of the SUP 12. More specifically, the seat assembly 14 can be moved between a stow position 18 on the upper surface 16 near the bow 20 of the SUP 12, and a paddle position 22 (see FIG. 2B) near mid-board on the upper surface 16, toward the stern 24 of the SUP 12. In FIG. 2A, the seat assembly 14 is shown in its stowed configuration, at the stow position 18. And, in FIG. 2B, the seat assembly 14 is shown in its sitting configuration, at the paddle position 22.

Figure 3A:
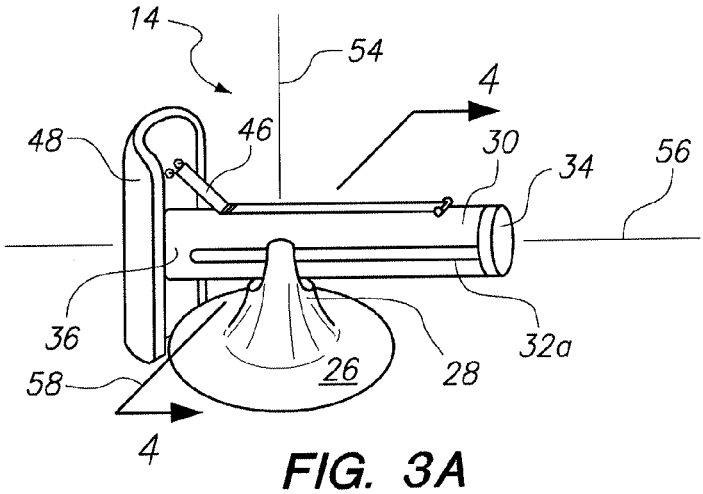
FIG. 3A is a perspective view of the seat assembly in a stowed configuration.
Figure 3B:
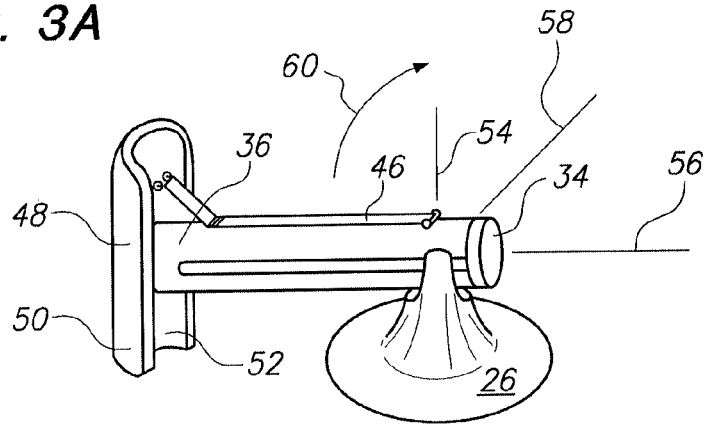
FIG. 3B is a perspective view of the seat assembly in an intermediate configuration.
Figure 4:
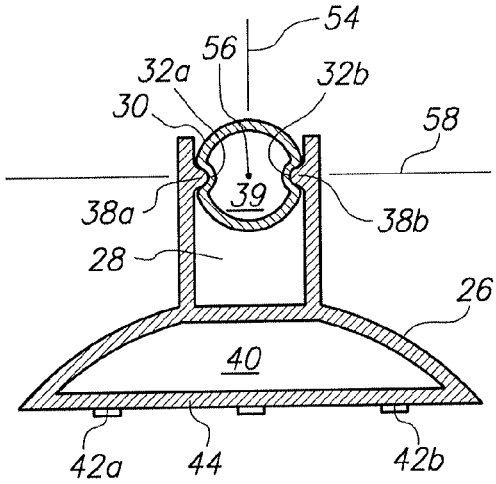
FIG. 4 is a cross section view of the seat assembly as seen along the line 4-4 in FIG. 3A.

Structural aspects of the seat assembly 14 will be best appreciated with reference to FIGS. 3A and 3B, with cross reference with FIG. 4. In FIG. 3A it will be seen that the seat assembly 14 includes a base member 26 that is formed with a receptacle 28. Further, FIG. 3A shows that the base member 26 and its receptacle 28 interact directly with a support shaft 30. For this interaction, the support shaft 30 is formed with a pair of slots 32*a* and 32*b* that are formed diametrically opposite each other on the support shaft 30. Further, the slots 32*a* and 32*b* are aligned in parallel between end 34 and end 36 of the support shaft 30.

Referring now to FIG. 4, with cross reference back to FIG. 3A, it will be appreciated that protrusions 38*a* and 38*b* are formed as part of the receptacle 28. As shown, the protrusions 38*a* and 38*b* are respectively received into the slots 32*a* and 32*b* of the support shaft 30. In FIG. 4 it will also be seen that the support shaft 30 is formed with an internal buoyancy chamber 39. Likewise, the base member 26 may be optionally formed with an internal buoyancy chamber 40. Further, FIG. 4 shows that a plurality of pads 42 can be affixed to the bottom 44 of the base member 26 (pads 42*a* and 42*b* are only exemplary). For purposes of the present invention, the pads 42 can be made of rubber or any other material that will stabilize and help maintain the seat assembly 14 on the upper surface 16 of the SUP 12 during an on-the-water operation.

In FIGS. 3A and 3B it will be seen that the seat assembly 14 includes a strap handle 46 and a seat member 48. More specifically, the strap handle 46 is shown interconnecting the seat member 48 with the support shaft 30. Functionally, the strap handle 46 is provided for use by the user 10 when carrying the seat assembly 14, and to help facilitate a manipulation of the seat assembly 14 by the user 10 when it is being reconfigured between its stowed configuration and its sitting configuration. The manner in which this reconfiguration is accomplished is disclosed in greater detail below.

With reference to FIGS. 3A and 3B, it will be appreciated that the seat member 48 includes a seat cushion 50 that is positioned on the seat member 48. Preferably, the cushion 50 will be made of a light weight material and will be buoyant. Although the seat member 48 shown in FIGS. 3A and 3B is shaped as a cylindrical surface, the present invention envisions a variety of other shapes for the seat member 48 (e.g. a typical bicycle seat). In any event, the seat member 48 is affixed to the end 36 of the support shaft 30. In FIGS. 3A and 3B the support shaft 30 is shown attached to the concave inner surface 52 of a cylindrical shaped seat member 48.

An operation to reconfigure the seat assembly 14 between its stowed and sitting configurations will be best appreciated with reference to the different axes that are shown and identified in FIGS. 3A, 3B and 4. In these Figures, a base axis 54 is shown centered on the base member 26. More particularly, when the receptacle 28 of base member 26 is considered as a section of a hollow cylinder, the base axis 54 will be aligned with the longitudinal axis of this cylinder. On the other hand, a shaft axis 56 is defined as being aligned with the longitudinal axis of the cylindrical shaped support shaft 30. Also, a rotation axis 58 is established by the protrusions 38*a* and 38*b* of the receptacle 28 (specifically, see FIG. 4).

Figure 2B:
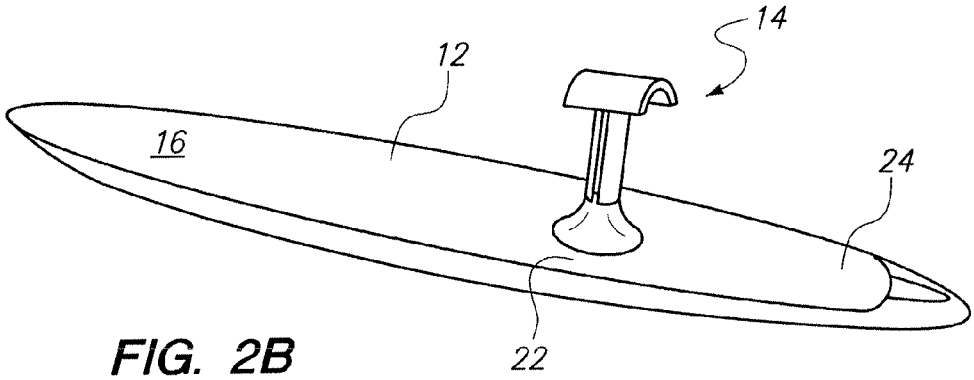
FIG. 2B is a perspective view of an SUP with the seat assembly of the present invention in a sitting configuration, and positioned near mid-board toward the stern of the SUP (paddle position)

Keeping in mind the various axes defined above (i.e. base axis 54, shaft axis 56, and rotation axis 58), a reconfiguration on the seat assembly 14 involves a transition between three different configurations. These are: a stowed configuration (FIGS. 2A and 3A); an intermediate configuration (FIG. 3B); and a sitting configuration (FIGS. 1 and 2B). With these various configurations in mind, it is envisioned that before there is an on-the-water reconfiguration of the seat assembly 14, it will initially be positioned near the bow of the SUP 12 in its stowed configuration. Subsequently, whenever the SUP user 10 wants to sit down on the seat assembly 14, the user 10 goes through a simple four-step procedure to reconfigure the seat assembly 14.

An on-the-water reconfiguration of the seat assembly 14 will most likely be preceded by first repositioning it on the SUP 12. To do this, the seat assembly 14 will typically remain in its stowed configuration (see FIGS. 2A and 3A). Note: in its stowed configuration, the shaft axis 56 of the support shaft 30 is substantially perpendicular to the base axis 54 of the base member 26; and the rotation axis 58 is positioned approximately midway between the ends 34 and 36 of the support shaft 30. Next, the seat assembly 14 is manipulated from its stowed configuration into an intermediate configuration (see FIG. 3B). In the intermediate configuration, the support shaft 30 has been moved, axially, to position the rotation axis 58 (defined by the protrusions 38*a* and 38*b* of receptacle 28) nearer to end 34 of the support shaft 30. Note: this repositioning also distances the seat member 48 from the base member 26, while the support shaft 30 is still substantially perpendicular to the base axis 54 of the base member 26. From its orientation in the intermediate configuration, the support shaft 30 is then rotated about the rotation axis 58 in the direction indicated by arrow 60 to coaxially align the shaft axis 56 of the support shaft 30 with the base axis 54 of the base member 26. The end 34 of the support shaft 30 is then inserted into the receptacle 28 of the base member 26 to establish the sitting configuration for the seat assembly 14. A return of the seat assembly 14 to its stowed configuration is then accomplished by essentially performing the four-step procedure in reverse order.

While the particular Stand-up Paddleboard Stool as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A seat assembly for use on a stand-up paddleboard which comprises:

a base member formed with a substantially cylindrical shaped receptacle, wherein the receptacle defines a base axis;

a hollow cylindrical shaped support shaft having a first end and a second end, and having an outer surface enclosing a buoyancy chamber inside the support shaft, wherein the support shaft defines a shaft axis and the outer surface of the support shaft is formed with diametrically opposed slots, wherein the slots are axially aligned on the support shaft and extend between the first and second ends thereof;

a seat member affixed to the first end of the support shaft; and a pair of protrusions are mounted on the base member and are diametrically opposed to each other relative to the base axis, wherein each protrusion is engaged with a respective slot on the support shaft for moving the support shaft on the base member between a first configuration wherein the support shaft rests on the base member with the shaft axis substantially perpendicular to the base axis, and a second configuration wherein the shaft axis is coaxially aligned with the base axis and the second end of the support shaft is inserted into the receptacle.

2. A seat assembly as recited in claim 1 wherein the base member is formed with a buoyancy chamber.

3. A seat assembly as recited in claim 1 further comprising an elongated strap handle having a first end connected to the seat member and a second end connected to the second end of the support shaft.

4. A seat assembly as recited in claim 1 wherein the seat member is semi-cylindrically shaped and has a convex outer surface and a concave inner surface, and wherein the inner surface is affixed to and centered on the first end of the support shaft.

5. A seat assembly as recited in claim 4 further comprising a cushion positioned over the convex outer surface of the seat member, wherein the cushion is made of a light weight foam material having a density less than the density of water.

6. A seat assembly as recited in claim 1 wherein the base member, the support shaft and the seat member are made of a light weight plastic material.

7. A seat assembly as recited in claim 1 further comprising a plurality of pads, wherein the base member is formed with a substantially flat bottom for interaction with the stand-up paddleboard and the plurality of pads are attached to the bottom of the base member to stabilize the interaction of the base member with the stand-up paddleboard.

8. A watercraft which comprises:

a stand-up paddleboard formed with a bow and a stern, and having an upper surface and a lower surface;

a seat assembly for use with the watercraft during an on-the-water operation of the watercraft, wherein the seat assembly can be selectively repositioned on the upper surface of the stand-up paddleboard between a stowing position and a paddle position, and wherein the seat assembly can be selectively reconfigured between a stowed configuration at the stowing position and a sitting configuration at the paddle position, wherein the seat assembly includes a base member formed with a substantially cylindrical shaped receptacle defining a base axis, and the seat assembly includes a hollow cylindrical shaped support shaft having a first end and a second end, and having an outer surface enclosing a buoyancy chamber inside the support shaft, wherein the support shaft defines a shaft axis and the outer surface of the support shaft is formed with diametrically opposed slots, wherein the slots are axially aligned on the support shaft and extend between the first and second ends thereof with a seat member affixed to the first end of the support shaft; and wherein the seat assembly further includes a pair of protrusions mounted on the base member and diametrically opposed to each other relative to the base axis, wherein each protrusion is engaged with a respective slot on the support shaft for moving the support shaft on the base member between the stowed configuration wherein the support shaft rests on the base member with the shaft axis substantially perpendicular to the base axis, and the sitting configuration wherein the shaft axis is coaxially aligned with the base axis and the second end of the support shaft is inserted into the receptacle; and a plurality of pads affixed to the seat assembly to grip the upper surface of the stand-up paddleboard for stabilizing the seat assembly at the selected position on the upper surface of the stand-up paddleboard.

9. A watercraft as recited in claim 8 wherein the stowing position is located near the bow of the stand-up paddleboard, and the paddle position is located near mid-board of the stand-up paddleboard.

10. A watercraft as recited in claim 8 wherein the base member is formed with a buoyancy chamber.

11. A watercraft as recited in claim 8 further comprising an elongated strap handle having a first end connected to the seat member and a second end connected to the second end of the support shaft.

12. A watercraft as recited in claim 8 wherein the seat member is semi-cylindrically shaped and has a convex outer surface and a concave inner surface, and wherein the inner surface is affixed to and centered on the first end of the support shaft.

13. A watercraft as recited in claim 12 further comprising a cushion positioned over the convex outer surface of the seat member, wherein the cushion is made of a light weight foam material having a density less than the density of water.

14. A watercraft as recited in claim 8 wherein the base member, the support shaft and the seat member are made of a light weight plastic material.

15. A watercraft as recited in claim 8 wherein the projections comprise a plurality of pads, and wherein the base member is formed with a substantially flat bottom for interaction with the stand-up paddleboard and the plurality of pads are attached to the bottom of the base member to stabilize the interaction of the base member with the stand-up paddleboard.

16. A method for using a seat assembly on a stand-up paddleboard, wherein the stand-up paddleboard is formed with a bow and a stern, and has an upper surface and a lower surface, the method comprising the steps of:

positioning the seat assembly in a stowed configuration at a stowing position on the upper surface of the stand-up paddleboard, for subsequent use during an on-the-water operation of the stand-up paddleboard, wherein the seat assembly comprises a base member formed with a substantially cylindrical shaped receptacle defining a base axis, a hollow cylindrical shaped support shaft having a first end and a second end and defining a shaft axis and wherein the outer surface of the support shaft is formed with diametrically opposed slots with the slots axially aligned on the support shaft to extend between the first and second ends thereof, a seat member affixed to the first end of the support shaft, and a pair of protrusions mounted on the base member diametrically opposed to each other relative to the base axis, wherein each protrusion is engaged with a respective slot on the support shaft for moving the support shaft on the base member between a stowed configuration wherein the support shaft rests on the base member with the shaft axis substantially perpendicular to the base axis and a sitting configuration wherein the shaft axis is coaxially aligned with the base axis and the second end of the support shaft is inserted into the receptacle;

repositioning the seat assembly to a paddle position on the upper surface of the stand-up paddleboard; and reconfiguring the seat assembly from the stowed configuration into a sitting configuration for use at the paddle position by manipulating the seat assembly into an intermediate configuration wherein the support shaft has been moved to position the protrusions on the base member in the slots of the support shaft at the second end of the support shaft, and by rotating the support shaft about an axis defined by the protrusions on the base member to coaxially align the shaft axis of the support shaft with the base axis of the base member; and inserting the second end of the support shaft into the receptacle of the base member to establish the sitting configuration for the seat assembly.

17. A method as recited in claim 16 wherein the stowing position is located near the bow of the stand-up paddleboard, and the paddle position is located near mid-board of the stand-up paddleboard.

18. A method as recited in claim 16 wherein the seat member is semi-cylindrically shaped and has a convex outer surface and a concave inner surface, and wherein the inner surface is affixed to and centered on the first end of the support shaft.

* * * * *